US008451274B2

(12) United States Patent
Tsay et al.

(10) Patent No.: US 8,451,274 B2
(45) Date of Patent: May 28, 2013

(54) METHOD AND DEVICE OF DISPLAYING CHARACTERS

(75) Inventors: Wei-Pung Tsay, Tainan County (TW); Shu-Ming Liu, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 1465 days.

(21) Appl. No.: 11/892,856

(22) Filed: Aug. 28, 2007

(65) Prior Publication Data

US 2008/0068388 A1 Mar. 20, 2008

(30) Foreign Application Priority Data

Sep. 15, 2006 (TW) ..... 95134318 A

(51) Int. Cl.
*G09G 5/24* (2006.01)

(52) U.S. Cl.
USPC ..... 345/467; 345/551

(58) Field of Classification Search
CPC ..... G09G 5/24
USPC ..... 345/467, 551; 348/589
See application file for complete search history.

(56) References Cited

U.S. PATENT DOCUMENTS

| | | | | |
|---|---|---|---|---|
| 5,847,770 | A | 12/1998 | Yagasaki | |
| 5,883,640 | A * | 3/1999 | Hsieh et al. | 345/467 |
| 6,046,778 | A | 4/2000 | Nonomura et al. | |
| 6,718,519 | B1 | 4/2004 | Taieb | |
| 2001/0026231 | A1 * | 10/2001 | Satoh | 341/87 |
| 2006/0119602 | A1 * | 6/2006 | Fisher et al. | 345/441 |

FOREIGN PATENT DOCUMENTS

TW I253297 4/2006

* cited by examiner

*Primary Examiner* — Jeffrey A Brier
(74) *Attorney, Agent, or Firm* — Rabin & Berdo, P.C.

(57) ABSTRACT

A method of displaying characters is adapted to a displaying device. First, the displaying device receives and analyzes a frame to obtain subtitle data including a first character. Then, the subtitle data is analyzed to obtain at least one first location of the first character on the frame. Finally, the first character is displayed at the at least one first location in a first time period.

15 Claims, 5 Drawing Sheets

Share Part

```
//Pseudo code
SetDstPitch();
SetOutputPixelFormat();
CommonRegister();
```

Independent Part

```
For(i=0;i<N;i+1)
{
  SetDstAddress();
  SetForeGroundColor();
  SetBackGroundColor();
  TriggerBitblt();
}
```

FIG. 5

METHOD AND DEVICE OF DISPLAYING CHARACTERS

This application claims the benefit of Taiwan application Serial No. 95134318, filed Sep. 15, 2006, the subject matter of which is incorporated herein by reference.

BACKGROUND OF THE INVENTION

1. Field of the Invention

The invention relates in general to a method and a device of displaying a character or characters, and more particularly to a character displaying method and a character displaying device capable of decreasing a memory bandwidth.

2. Description of the Related Art

Due to the flourishing development of the consumer electronic product, the video/audio entertainment product has become an indispensable part in the daily life of the human being. In addition, the changing technology with each passing day has brought the people more and more different enjoyments. For example, the conventional television only can receive the signal transmitted from a wireless television station, and the number of the channels that may be selected by the user is limited. With the popularization of the cable television system, the user can watch the programs in the domestic cable channels as well as abroad television channels so that the options of the users are greatly increased. Recently, a digital television or a setup box with the function of browsing the Internet has been developed in the market in order to provide the user more and more choices.

When a displaying device in the conventional television, the digital television or the setup box is connected to a cable/wireless television channel or Internet, the displaying device receives frames of the television program or the webpage, and represents and displays the characters of the frame one by one in an order from left to right and from top to bottom. During the conventional character displaying process, a central processing unit (CPU) of the displaying device reads bitmap raw data of a first character from a system memory, and then transfers the bitmap raw data to an off-screen memory. Then, a graphic engine chip generates character representing data according to the bitmap raw data of the character in conjunction with a suitable color extension or conversion command, records the character representing data in an on-screen memory, and displays the character representing data on a screen. The above-mentioned steps are repeated until all the characters have been processed and displayed on the screen.

However, the same character has the extremely high repetition rate in the same frame. If the character "a" appears four times in the same frame, the conventional method is to deliver the bit map data of the character "a" from the system memory to the off-screen memory four times. Thus, a lot of memory bandwidths may be occupied so that the system efficiency of the displaying device is greatly reduced. Consequently, how to display all characters of a frame on a screen effectively is a problem to be solved.

SUMMARY OF THE INVENTION

The invention is directed to a character displaying method and a character displaying device capable of effectively reducing a memory bandwidth of a memory, reducing the number of operations of accessing a graphic processing chip, and thus enhancing the system efficiency of the displaying device.

According to a first aspect of the present invention, a character displaying method adapted to a displaying device is provided. First, the displaying device receives and analyzes a frame to obtain subtitle data including a first character. Next, the subtitle data is analyzed to obtain at least one first location of the first character on the frame. Finally, the first character is displayed at the at least one first location.

According to a second aspect of the present invention, a displaying device is provided. The displaying device is coupled to a network system and receives and displays a frame. The displaying device includes a displaying unit, a processing unit and a graphic engine. The processing unit receives and analyzes the frame to obtain subtitle data including a first character, and then analyzes the subtitle data to obtain at least one first location of the first character on the frame. The graphic engine displays the first character at the at least one first location.

The invention will become apparent from the following detailed description of the preferred but non-limiting embodiments. The following description is made with reference to the accompanying drawings.

BRIEF DESCRIPTION OF THE DRAWINGS

FIG. 5 is a schematic illustration showing an example of an operation command of a graphic engine chip according to the preferred embodiment of the invention.

DETAILED DESCRIPTION OF THE INVENTION

The displaying device according to the embodiment of the invention has changed to be different from the method of sequentially representing and displaying the characters from left to right and from top to bottom, but to analyze and classify the received subtitle data and to rearrange the order of all the characters of the subtitle data so that the graphic engine chip can represent all the characters according to the new order.

Figure 1:
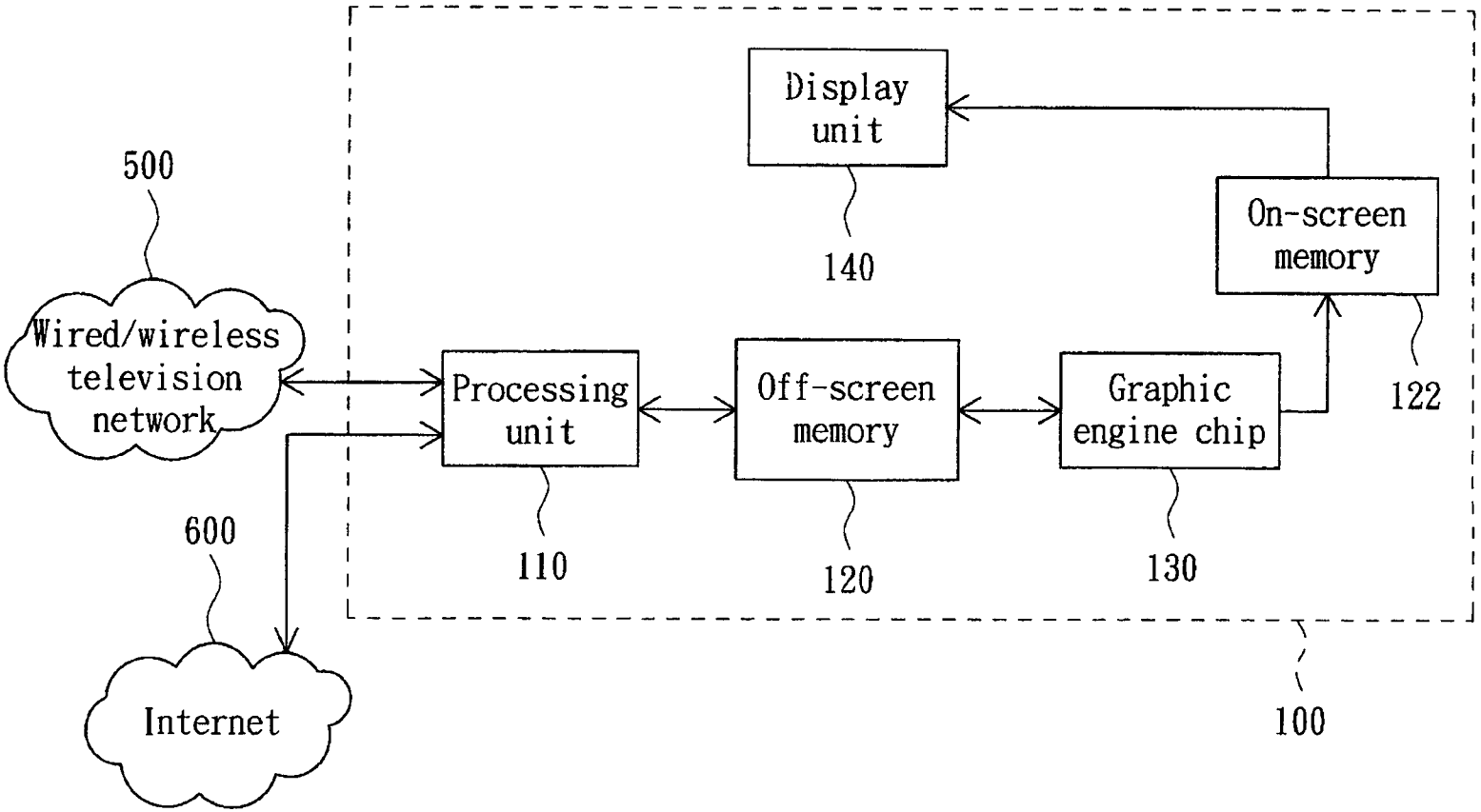
FIG. 1 is a schematic illustration showing a displaying device according to a preferred embodiment of the invention.

FIG. 1 is a schematic illustration showing a displaying device 100 according to the preferred embodiment of the invention. As shown in FIG. 1, the displaying device 100, which may be a conventional television, a conventional digital television, a conventional setup box or a conventional personal computer having a TV tuner card, is connected to a cable/wireless television network 500 to receive a television program. Alternatively, the displaying device 100 may be connected to an Internet 600 to receive the webpage. The displaying device 100 includes a processing unit 110, an off-screen memory 120, an on-screen memory 122, a graphic engine chip 130 and a display unit 140. In this embodiment, the display unit 140 is a television screen or a computer screen. The processing unit 110 receives a frame coming from the cable/wireless television network 500 or the Internet 600 and analyzes the frame to obtain subtitle data. The subtitle data includes different characters appearing on the frame, and each character appears more than one time.

After obtaining the subtitle data, the processing unit 110 analyzes all the characters of the subtitle data to obtain locations of the characters appearing on the frame. Next, the processing unit 110 creates a character link list for recording the locations of all the characters of the subtitle data appearing on the frame.

Then, the processing unit 110 calls an application program interface, which rearranges nodes in the character link list to adjust the order of displaying all the characters in the subtitle data.

The processing unit 110 stores the bitmap raw data of the characters from the system memory to the off-screen memory 120 according to the character link list. The graphic engine chip 130 generates and represents the characters in the on-screen memory 122, and displays the characters on the display unit 140 according to the bitmap raw data of the character of the off-screen memory 120 in conjunction with a color extension or conversion command.

Figure 2:
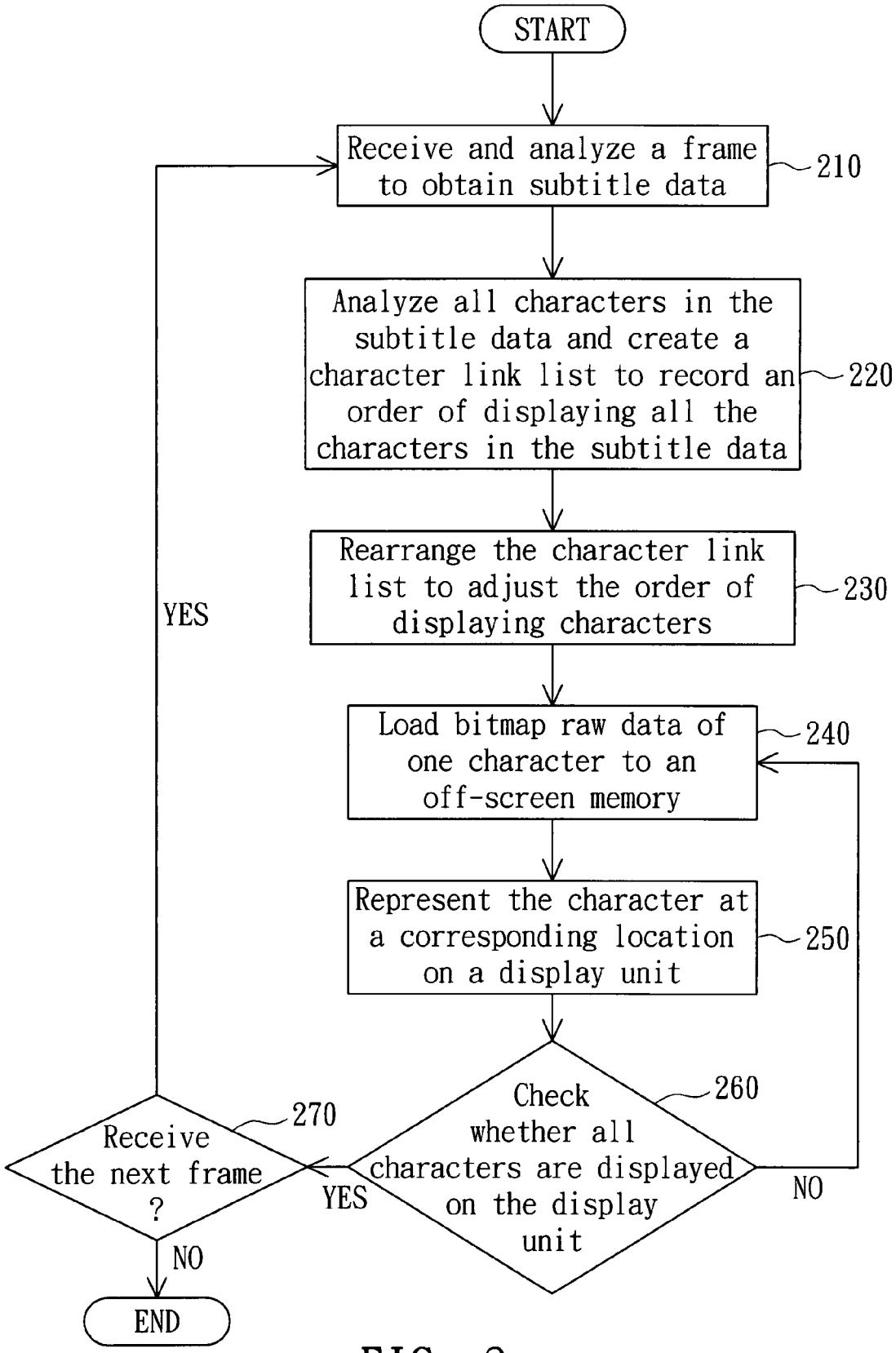
FIG. 2 is a flow chart showing a character displaying method according to the preferred embodiment of the invention.

FIG. 2 is a flow chart showing a character displaying method according to the preferred embodiment of the invention. First, the displaying device 100 performs step 210 to analyze the frame to obtain the subtitle data using the processing unit 110 after receiving the frame. The subtitle data includes several characters, such as a first character and a second character.

Next, in step 220, the processing unit 110 sequentially analyzes the first character and the second character and creates the character link list to record the locations of the first character and the second character on the frame. The first character appears at one or more than one location on the frame, such as a first location on the frame, and the second character appears at one or more than one location on the frame, such as a second location on the frame.

In step 230, the processing unit 110 calls the application program interface to rearrange the character link list to adjust the order of displaying the first character and the second character.

In step 240, a character, such as the first character, is taken out from the character link list so that the bitmap raw data of the character is loaded from the system memory into the off-screen memory 120. In addition, the commands for operating the graphic engine chip 130 are stored in a graphic register according to the attribute of the first character, such as the location and the color.

In step 250, the graphic engine chip 130 generates a first representing character according to the bitmap raw data of the first character in the off-screen memory 120 and the commands or command in the graphic register at all the associated locations in the on-screen memory 122.

That is, steps 240 and 250 make the graphic engine chip 130 represent all the first characters in the on-screen memory 122 (i.e., display all the first characters at at least one first location on the frame) in a first time period, and represent all the second characters in the on-screen memory 122 (i.e., display the second characters at at least one second location on the frame) in a second time period.

Next, in step 260, it is checked whether all the characters have been completely represented. If yes, step 270 is performed, or otherwise the procedure goes back to step 240 to continue representing the second character, for example.

In step 270, it is checked whether the next frame is received. If the next frame is received, the procedure goes back to step 210, and the processing unit 110 receives and analyzes the next frame. If not, the method of displaying the characters ends.

Figure 3:
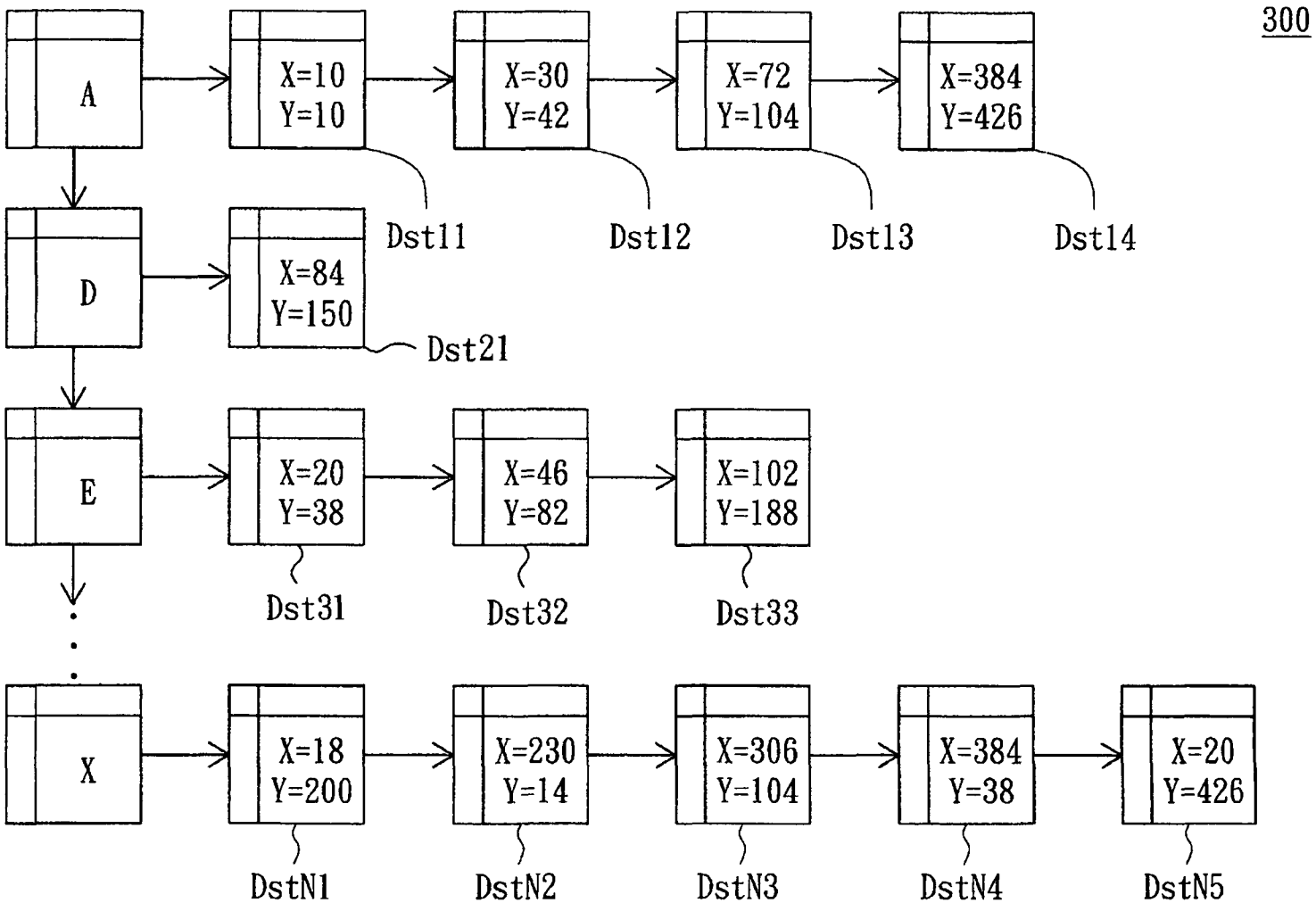
FIG. 3 is a schematic illustration showing a character link list according to the preferred embodiment of the invention.

FIG. 3 is a schematic illustration showing a character link list 300 according to the preferred embodiment of the invention. Referring to FIG. 3, the processing unit 110 analyzes all the characters of the subtitle data, creates the nodes at all the locations of the characters appearing on the frame, records the nodes in the character link list 300, and re-sorts the nodes so that the nodes of the same character are connected in series. Each node is defined by an X coordinate and a Y coordinate. For example, the character "A" is the first character of the subtitle data and appears at four locations Dst11, Dst12, Dst13 and Dst14 on the frame. The four locations are created as the four nodes linked to a first sub-list associated with the character "A". The second character is the character "D" appearing at one location Dst21 on the frame. The node is linked to the sub-list associated with the character "D". The third character is the character "E" appearing at three locations Dst31, Dst32 and Dst33 on the frame. The three nodes are linked to the sub-list associated with the character "E". Analogically, the Nth character is the character "X" appearing at five locations DstN1, DstN2, DstN3, DstN4 and DstN5 on the frame. The five nodes are linked to the sub-list associated with the character "X".

Figure 4:
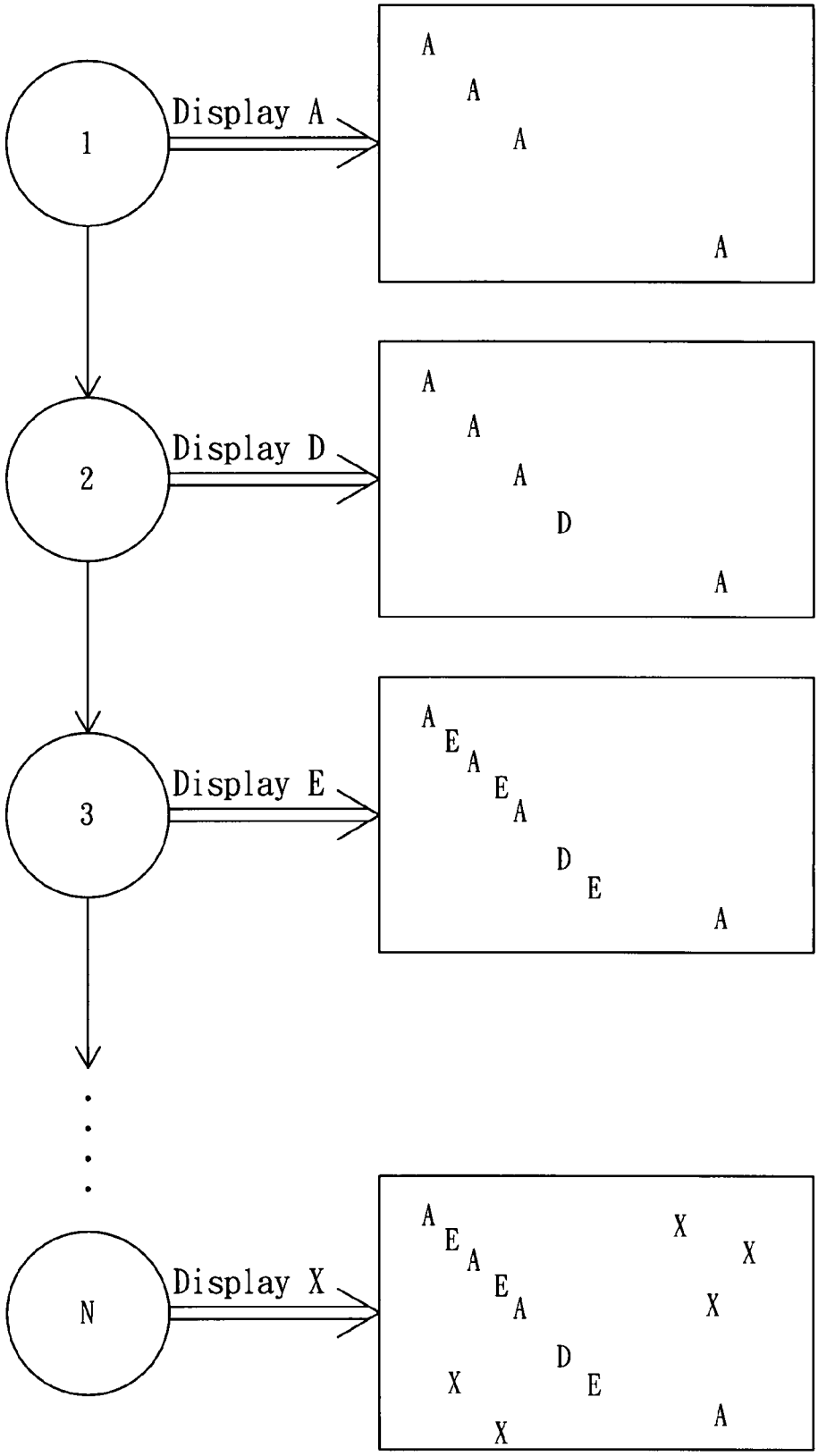
FIG. 4 is a schematic illustration showing a character displaying order according to FIG. 3.

FIG. 4 is a schematic illustration showing a character displaying order according to FIG. 3. In the first time period, the graphic engine chip 130 simultaneously represents the character "A" at the four different locations Dst11, Dst12, Dst13 and Dst14 (as shown in FIG. 3) in the corresponding on-screen memory 122 so that the character "A" may be displayed on the display unit 140. In the second time period, the graphic engine chip 130 represents the character "D" at the location Dst21 (as shown in FIG. 3) in the corresponding on-screen memory 122. In the third time period, the graphic engine chip 130 simultaneously represents the character "E" at the three different locations Dst31, Dst32 and Dst33 (as shown in FIG. 3) in the corresponding on-screen memory 122. Analogically, in the $N^{th}$ time period, the graphic engine chip 130 simultaneously represents the character "X" at the five different locations DstN1, DstN2, DstN3, DstN4 and DstN5 (as shown in FIG. 3) in the corresponding on-screen memory 122.

FIG. 5 is a schematic illustration showing an example of an operation command of a graphic engine chip according to the preferred embodiment of the invention. As shown in FIG. 5, the "Share Part" command includes all commands for setting the common information of the display unit. For example, SetDstPitch( ) is for setting the width of the screen of the display unit, SetOutputPixelFormat( ) is for setting the pixel format, and CommonRegister( ) is for setting the common register.

The "Independent Part" command includes the commands to be executed by each character displayed at each location. For example, SetDstAddress( ) is for setting the display location of the character, and SetForeGroundColor( ) and SetBackGroundColor( ) are for setting the color of the character. If one character is displayed at different locations with the same color, these commands may serve as the "Share Part" command. Consequently, the operations of accessing the register of the graphic engine chip may be saved. TriggerBitblt( ) is for triggering the graphic engine chip 130 to start representing.

Conventionally, if one character appears in a frame N times and the "Share Part" command needs to access the register M times, the graphic engine chip needs M×N access commands to display the character at all the corresponding locations according to the conventional character displaying method. In the embodiment of the invention, the graphic engine chip only needs to execute the "Share Part" command once on the character because the same character at different locations is simultaneously displayed on the display unit. Compared with the prior art method, the method according to the embodiment of the invention saves M×(N−1) operations of accessing the register so that the system efficiency of the displaying device is effectively enhanced.

Preferably, the subtitle data received by the displaying device according to the embodiment of the invention is closed caption data or teletext data. In the character link list of the embodiment of the invention, only the letters are illustrated as an example. In practice, all the characters of the subtitle data may be the characters, such as letters, digits, punctuation marks or control symbols, having the high repetition rate.

The embodiment of the invention can greatly decrease the number of times of accessing the register by the graphic engine chip, and can also reduce the consumed memory bandwidth for displaying the subtitle data of one frame so that the used efficiency of the displaying device can be effectively enhanced. In addition, the graphic engine chip can access the register according to some common commands to enhance the parallel processing and thus to enhance the processing efficiency of the graphic engine chip.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A character displaying method adapted to an electronic displaying device, which is for receiving and displaying a frame, the method comprising the steps of:

analyzing, by the electronic displaying device, the frame to obtain subtitle data, which comprises a first character and a second character;

analyzing, by the electronic displaying device, the subtitle data to obtain first display locations of the first character and second display locations of the second character on the frame;

creating, by the electronic displaying device, a character link list, wherein the first display locations of the first character and the second display locations of the second character on the frame are recorded in the character link list serially;

storing, by the electronic displaying device, the first character in an off-screen memory corresponding to the first display locations, and storing the second character in the off-screen memory corresponding to the second display locations; and representing, by the electronic displaying device, the first character and the second character on an on-screen memory from the off-screen memory for displaying the first character and the second character.

2. The method according to claim 1, further comprising:

sorting, by the electronic displaying device, the character link list so that the electronic displaying device simultaneously displays the first character at the first display locations.

3. The method according to claim 1, further comprising:

sorting, by the electronic displaying device, the character link list for simultaneously displaying the second character at the second display locations.

4. The method according to claim 1, wherein the subtitle data is closed caption data or teletext data.

5. A displaying device for receiving and displaying a frame, the displaying device comprising:

a display unit;

a processing unit for receiving and analyzing the frame to obtain subtitle data, which comprises a first character and a second character, and then analyzing the subtitle data to obtain first display locations of the first character and second display locations of the second character on the frame;

a graphic engine; and an off-screen memory and an on-screen memory;

wherein the processing unit stores the first character in the off-screen memory corresponding to the first display locations, and stores the second character in the off-screen memory corresponding to the second display locations; and the graphic engine represents the first character and the second character on the on-screen memory from the off-screen memory for displaying the first character and the second character on the display unit.

6. The device according to claim 5, wherein the processing unit is further for creating a character link list, and the first display locations of the first character and the second display locations of the second character on the frame are recorded in the character link list serially.

7. The device according to claim 6, wherein the processing unit adjusts an order of displaying the first character and the second character in the character link list such that the displaying device simultaneously displays the first character at the first display locations and simultaneously displays the second character at the second display locations.

8. The device according to claim 7, wherein:

the processing unit stores bitmap raw data of the first character and the second character to the off-screen memory, and the graphic engine is coupled to the off-screen memory, and represents the first character at the first display locations and represents the second character at the second display locations on the display unit according to the bitmap raw data of the first character and the second character.

9. The device according to claim 8, wherein:

the on-screen memory is for receiving the represented first character and second character and outputting the represented first character and second character to the display unit.

10. The device according to claim 5, wherein each of the first character and the second character is a letter, a digit, a punctuation mark or a control symbol.

11. The device according to claim 5, wherein the subtitle data is closed caption data or teletext data.

12. A character displaying method adapted to an electronic displaying device, which is for receiving frame data and thus displaying a frame, the method comprising the steps of:

analyzing, by the electronic displaying device, the frame data to obtain subtitle data;

analyzing, by the electronic displaying device, the subtitle data to obtain first display locations of a first character so as to display the first character at the first display locations of the frame, and to obtain second display locations of a second character so as to display the second character at the second display locations of the frame;

storing, by the electronic displaying device, the first character in an off-screen memory corresponding to the first display locations, and storing the second character in the off-screen memory corresponding to the second display locations; and representing, by the electronic displaying device, the subtitle data on an on-screen memory from the off-screen memory so that the first character is simultaneously represented at the first display locations of the first character, and then the second character is simultaneously represented at the second display locations of the second character.

13. The method according to claim 12, wherein the step of analyzing the subtitle data comprises:

scanning, by the electronic displaying device, the subtitle data to create a corresponding node according to the first display locations and the second display locations at which the first character and the second character are to be displayed; and linking, by the electronic displaying device, the nodes to form a character link list.

14. The method according to claim 13, wherein the step of representing the subtitle data comprises:

sorting, by the electronic displaying device, the character link list to make the nodes corresponding to the first character be connected in series, and to make the nodes corresponding to the second character be connected in series; and sequentially displaying, by the electronic displaying device, the first character and the second character according to the character link list.

15. The method according to claim 12, wherein the subtitle data is closed caption data or teletext data.

* * * * *